US007736406B2

(12) United States Patent
Kuroki et al.

(10) Patent No.: US 7,736,406 B2
(45) Date of Patent: Jun. 15, 2010

(54) VACUUM CLEANER

(75) Inventors: Yoshiki Kuroki, Omihachiman (JP); Hideaki Sakatani, Higashiomi (JP); Seiji Ishikawa, Higashiomi (JP); Atsushi Kitai, Otsu (JP)

(73) Assignee: Panasonic Corporation, Osaka (JP)

( * ) Notice: Subject to any disclaimer, the term of this patent is extended or adjusted under 35 U.S.C. 154(b) by 904 days.

(21) Appl. No.: 11/192,064

(22) Filed: Jul. 29, 2005

(65) Prior Publication Data

US 2006/0042203 A1 Mar. 2, 2006

(30) Foreign Application Priority Data

Aug. 30, 2004 (JP) ..... 2004-249768

(51) Int. Cl.
*B01D 46/04* (2006.01)

(52) U.S. Cl. ..... 55/300; 55/DIG. 3; 55/304; 15/352

(58) Field of Classification Search ..... 55/DIG. 3, 55/320, 342, 345, 377, 418, 428, 467, 300, 55/304, 305, 295, 282, 289; 95/282; 15/352, 15/323, 326
See application file for complete search history.

(56) References Cited

U.S. PATENT DOCUMENTS 3,591,888 A * 7/1971 Takeda et al. ..... 15/323
3,621,640 A * 11/1971 Ohno et al. ..... 55/300
3,708,962 A * 1/1973 Deguchi et al. ..... 55/300
3,731,465 A * 5/1973 Ohira et al. ..... 55/299
3,841,067 A * 10/1974 Kato et al. ..... 55/300
4,385,413 A * 5/1983 Goldsmith ..... 15/322
4,592,764 A * 6/1986 Ikezaki et al. ..... 96/382
6,174,350 B1 * 1/2001 Rohn et al. ..... 95/218
6,361,587 B1 * 3/2002 Rohn et al. ..... 95/218
7,346,957 B2 * 3/2008 Nakamoto et al. ..... 15/352

FOREIGN PATENT DOCUMENTS

EP 0 024 636 A1 3/1981
JP 2004-216009 8/2004

* cited by examiner

*Primary Examiner*—Duane Smith
*Assistant Examiner*—Sonji Turner
(74) *Attorney, Agent, or Firm*—Bacon & Thomas, PLLC

(57) ABSTRACT

A vacuum cleaner includes a main body accommodating therein an electric blower and a dust-removal driving body; and a filter unit including a frame body where a filter for collecting dust particles is installed and a dust removing plate provided at a downstream side of the filter, one end of the dust removing plate being fixed at the frame body. The other end of the dust removing plate is struck in an air flow direction by means related with driving the dust-removal driving body, thereby transmitting an impact on the frame body with a repulsive force thereof.

16 Claims, 16 Drawing Sheets

VACUUM CLEANER

FIELD OF THE INVENTION

The present invention relates to a vacuum cleaner; and, more particularly, to a vacuum cleaner having a dust removing function.

BACKGROUND OF THE INVENTION

As for a conventional vacuum cleaner, there is provided a vacuum cleaner having a dust separation unit, a pleat-shaped filter for capturing fine dust particles contained in the air that has passed the dust separation unit, a gear rotated in relation with a winding operation of a power cord and protrusions installed on the gear. In this vacuum cleaner, while the power cord is being wound, the gear is being rotated therealong to thereby make the protrusions rotate together. The rotating protrusions keep making hard contacts against pleats of the filter to thereby impart rotational motions to the rear surface of the filter as well as vibrations to the pleats, wherein the vibrations make dust particles attached to the filter be dusted off therefrom. (e.g., see Japanese Patent No. 3490081)

However, for such a configuration of the conventional vacuum cleaner, even though dust particles are accumulated on a surface of the filter in an opposite direction of an air flow, since vibrations are applied to the filter in a direction perpendicular to the pleats, i.e., in a direction perpendicular to the air flow, a dust removal efficiency becomes deteriorated. Further, since the vibrations are directly applied to the filter by the protrusions, the filter needs to be made strong, thereby increasing cost thereof.

SUMMARY OF THE INVENTION

It is, therefore, an object of the present invention to provide a vacuum cleaner of a high dust removal efficiency.

In accordance with a preferred embodiment of the present invention, there is provided a vacuum cleaner including: a main body accommodating therein an electric blower and a dust-removal driving body; and a filter unit having a frame body where a filter for collecting dust particles is installed and a dust removing plate provided at a downstream side of the filter, one end of the dust removing plate being fixed at the frame body, wherein the other end of the dust removing plate is struck in an air flow direction by means related with driving the dust-removal driving body, thereby transmitting an impact on the frame body with a reaction force thereof. Dust particles attached to the filter effectively are dusted off due to an instant impact applied by the dust removing plate in an opposite direction of an air flow, i.e., in a dust particle accumulation direction and, thus, a filtering capability of the filter is recovered. Further, since the dust removing plate does not directly apply an impact to the filter, the filter is free from damage.

It is preferable that a vacuum cleaner further includes a cord reel with a power cord wound therearound, for driving the dust-removal driving body by means related with an extracting and/or retracting operation of the power cord. Since there is no need to provide an additional driving source for rotating the dust-removal driving body, a dust removing mechanism can be manufactured at a low cost.

Further, it is preferable that a vacuum cleaner further includes a motor for rotating the dust-removal driving body. With the motor, a dust removing configuration becomes simple, and a stable dust removal effect can be obtained.

Preferably, an upper portion of the dust removing plate may be fixed on that of the frame body. Accordingly, a configuration of the main body becomes simple and, accordingly, the stable dust removal effect can be realized.

Further, the filter may be vertically pleat-folded. With such configuration, dust particles that have been swept can be effectively dusted off and further can be prevented from being attached to the filter again.

It is preferable that an upstream surface of an upper portion of the filter is slightly inclined downward. Therefore, dust particles that have been swept can be effectively dusted off and further can be prevented from being attached to the filter again.

Further, it is preferable that a rib body for connecting pleat portions of the filter is formed as a unit in the frame body made of resin, and the rib body is struck by the dust removing plate. Since impact can be transmitted to an overall filter via the rib body, an effect of sweeping dust particles can be improved.

Preferably, a noise absorber may be installed at either one or both of the rib body and the dust removing plate, and a portion where the noise absorber is installed is configured to be struck. With the noise absorber, noise can be reduced during a dust removing process.

Further, it is preferable that an irregularity is provided at either one side or both sides of contact portions between the rib body and the dust removing plate, which allows the rib body and the dust removing plate to be point-contacted. With the irregularity, impact applied to the filter can be distributed and, also, sound quality can be changed or reduced during the dust removing process.

Furthermore, it is preferable that the contact portion between the rib body and the dust removing plate is provided at a portion where a large amount of dust particles are attached to the filter. By applying a strong impact to the portion where the large amount of dust particles are attached, the dust removing process can be effectively performed.

Preferably, stopper portions for restricting a bending degree of the dust removing plate may be installed at both sides of the dust removing plate. Accordingly, the dust removing plate can be prevented from being transformed by a collision with something else during an assembly process or the like.

It may be preferable that the dust removing plate is divided into at least two in the middle thereof, and each end portion thereof is struck by the dust-removal driving body. If each end portion is struck by the dust-removal driving body at different timings, it is possible to reduce an extraction force needed for extracting the power cord or a torque of a motor needed for rotating the dust-removal driving body.

Further, it is preferable that impact applied from the dust removing plate to the filter via the frame body is set to be greater than or equal to 150 G (acceleration of gravity). In this case, 80% of the amount of an initial air flow can be recovered.

Preferably, the dust-removal driving body may have a dust piece for striking an end portion of the dust removing plate and flanges provided at both sides of the dust piece so that the end portion of the dust removing plate is inserted between the flanges. With such configuration, it is possible to prevent the dust pieces from missing hitting the protrusions during the dust removing process, and further to prevent dust particles or the like from being caught in the dust-removal driving body.

Further, it is preferable that a vacuum cleaner further includes a detachable cover for covering a periphery of the dust-removal driving body. With the cover, it is possible to easily remove dust particles or foreign substances that have flown and been tangled in the dust-removal driving body.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Hereinafter, preferred embodiments of the present invention will be described with reference to the accompanying drawings. However, the present invention is not limited to those preferred embodiments.

First Preferred Embodiment

A vacuum cleaner in accordance with a first preferred embodiment will be described with reference to FIGS. 1 to 12.

Figure 1:
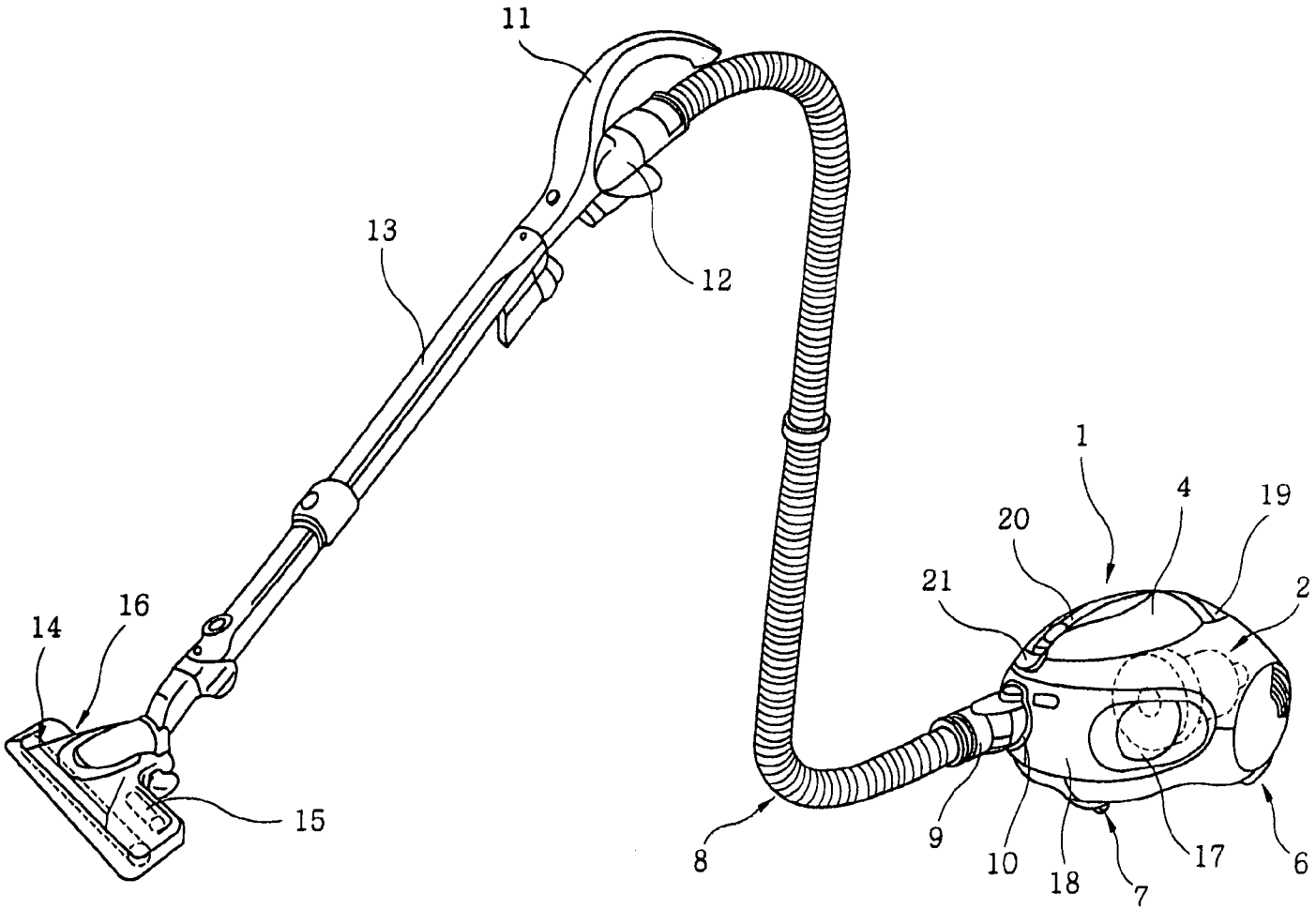
FIG. 1 is an overall perspective view of a vacuum cleaner in accordance with a first preferred embodiment of the present invention.
Figure 2:
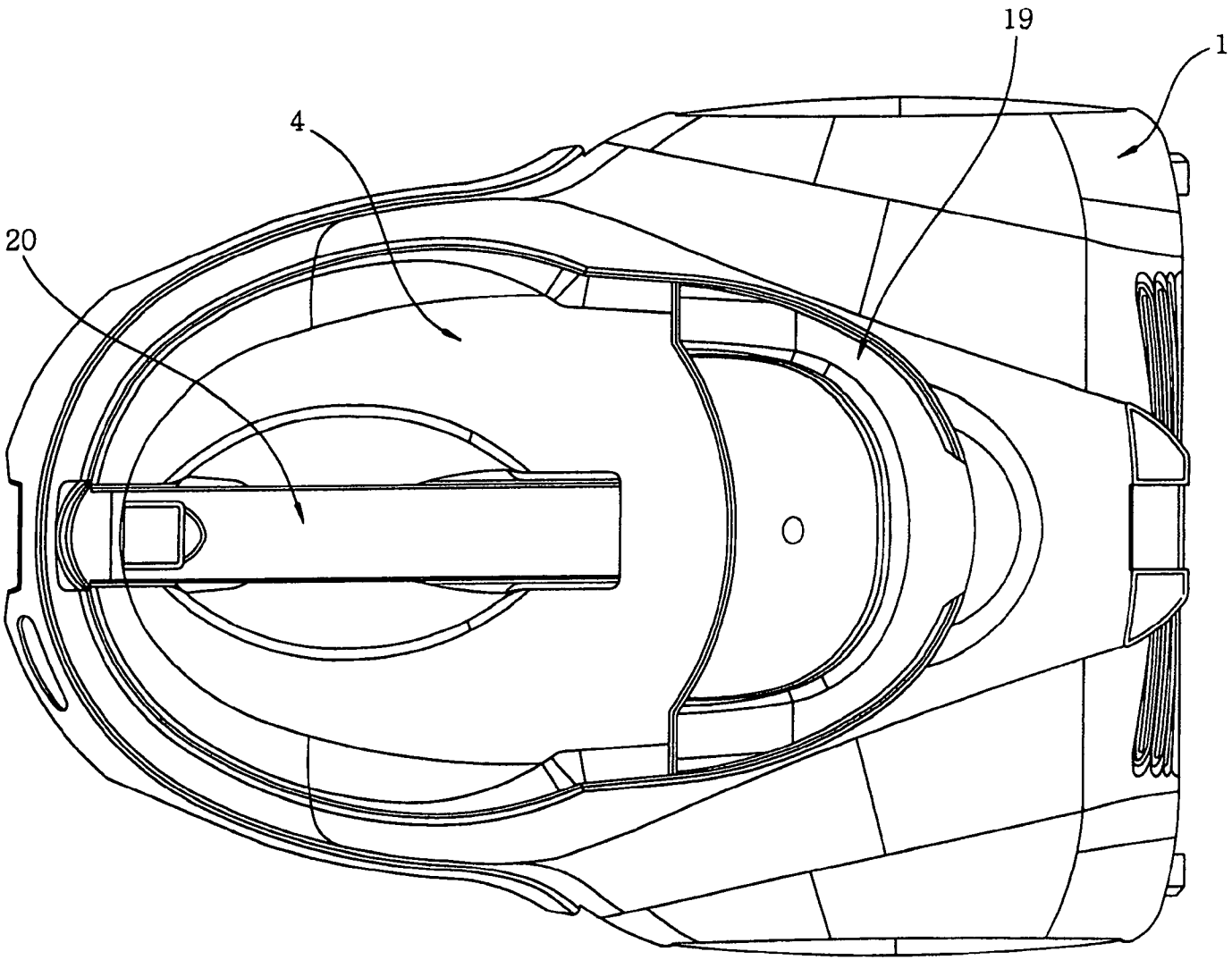
FIG. 2 shows a top view of the vacuum cleaner.

FIG. 1 is an overall perspective view of a vacuum cleaner of a first preferred embodiment; FIG. 2 shows a top view of the vacuum cleaner; and FIG. 3 describes a cross sectional view of the vacuum cleaner.

As shown in FIG. 1, reference numeral 1 represents a main body of a vacuum cleaner. Provided in the rear portion of main body 1 is electric blower chamber 3 mounting therein electric blower 2 and detachably provided in the front portion thereof is dust box receiving portion 5 for accommodating dust box unit 4 for separating and collecting dust particles. Further, two wheels 6 are rotatably installed on both lower side surfaces of a rear portion of main body 1 and swivel caster 7 is installed at a front bottom surface thereof. In addition, provided at a front portion of main body 1 is suction air inlet 10 to which one end of connection pipe 9 is detachably connected. The other end of connection pipe 9 is connected to one end of hose 8.

Installed at the other end of hose 8 is leading pipe 12 with a handle which can be gripped by a user when using the vacuum cleaner. Reference numeral 13 represents an extension tube functioning as a flexible member or a joint member. Extension tube 13 has one end detachably connected to leading pipe 12 on the downstream side and the other end detachably connected to suction head 16. Suction head 16 includes rotation brush 14 for lifting up dust particles and motor 15 for rotating rotation brush 14.

Reference numeral 17 represents an opening which is provided at a side surface of main body 1. Through opening 17, transparent outer sides of dust box unit 4 included in dust box receiving portion 5 can be viewed from outside.

Reference numeral 18 represents a bumper made of an elastic material for preventing furniture or house walls from getting damaged when main body 1 collides therewith. A portion of bumper 18, which faces opening 17 provided at main body 1, is cut out as shown in FIG. 1.

Reference numeral 19 represents a main body handle to be used for carrying main body 1. Main body handle 19 is raised when carrying main body 1. Further, main body handle 19 is rotatably installed at a top of main body 1 so that its rotational center is located on a vertical line passing through the center of main body 1.

Reference numeral 20 is a box handle for carrying dust box unit 4. An upper portion of box handle 20 is rotatably supported at dust box unit 4 and, a front end thereof is generally accommodated in dust box unit 4, as shown in FIG. 1. However, when dust box unit 4 is lifted and carried or when it is separated from dust box receiving portion 5 of main body 1, if the front portion of box handle 20 is lifted, the front end thereof is upwardly popped out, so that a user can grip box handle 20.

Reference numeral 21 is a hook for supporting the front end of dust box unit 4 accommodated in dust box receiving portion 5 of main body 1, wherein hook 21 for maintaining the front portion of dust box unit 4 is biased at a hook spring (not shown) toward a rear portion.

Figure 3:
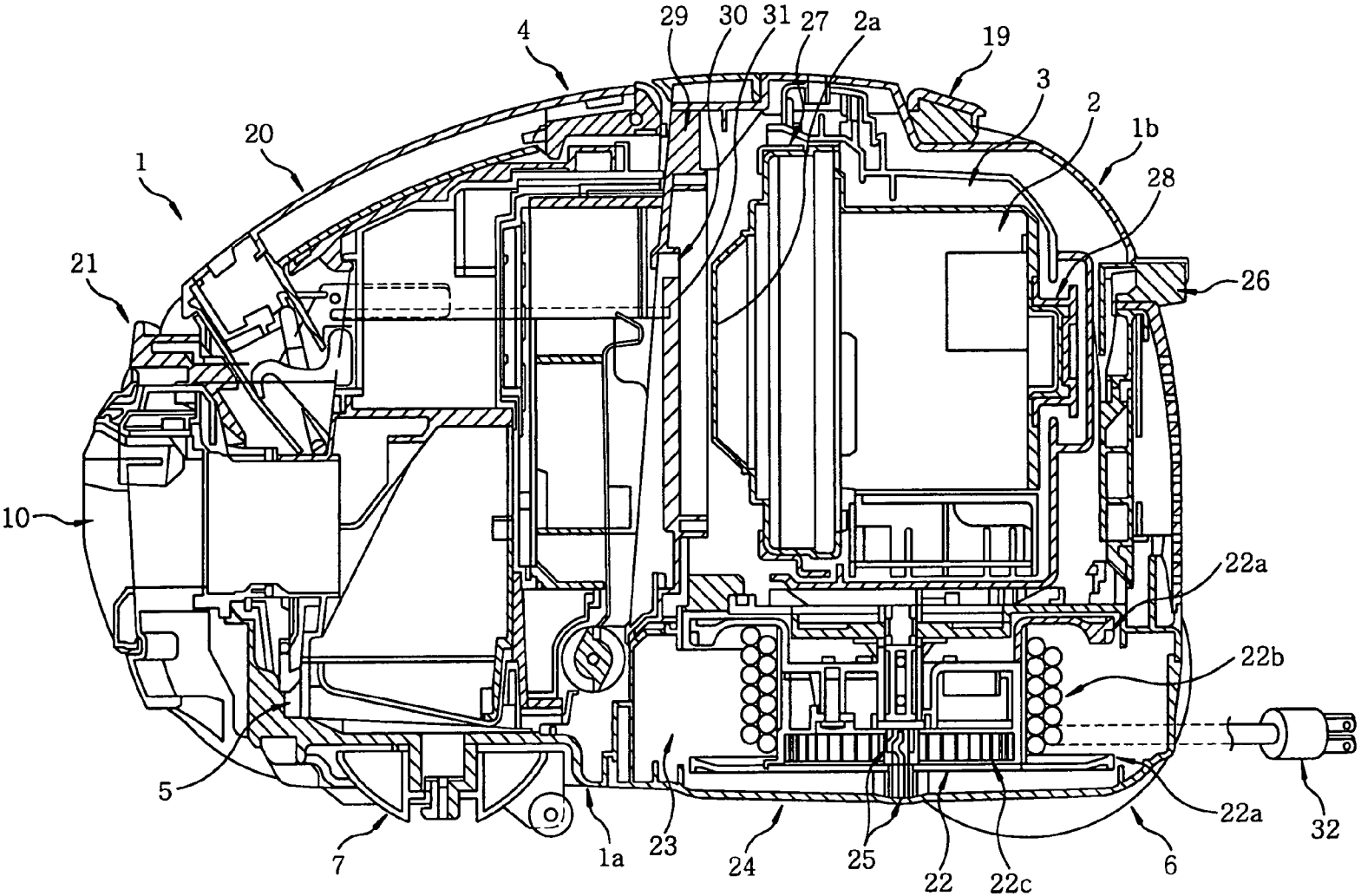
FIG. 3 describes a cross sectional view of the vacuum cleaner.

Referring to FIG. 3, the outer wall of main body 1 is formed of lower body 1*a* forming a lower part of main body 1 and upper body 1*b* wherein lower body 1*a* forms cord reel receiving portion 23 for incorporating cord reel 22 at its rear portion and upper body 1*b* forms electric blower chamber 3 at rear portion of main body 1. A bottom portion of electric blower chamber 3 is covered by lower body 1*a*. Reference numeral 24 is cord reel lid for covering cord reel receiving portion 23 formed at lower body 1*a*. Cord reel 22 is rotatably supported by axial supporting units 25 respectively provided at cord reel lid 24 and lower body 1*a*.

Cord reel 22 for winding power cord 32 includes drum portion 22*b* having at its upper and lower part flanges 22*a* and resilient members 22*c* for exerting pressing force against drum portion 22*b* in a direction that winds power cord 32.

Reference numeral 26 represents a rewind button for rewinding extracted power cord 32 onto cord reel 22 against the pressing force of resilient members 22*c* incorporated in cord reel 22. By pressing rewind button 26, a brake roller (not shown) which prevents cord reel 22 from being rotated is released from cord reel 22 which in turn allows cord reel 22 to rewind power cord 32 by means of the pressing force of resilient members 22*c*.

The front portion of electric blower 2 is supported by front support 27 and the rear portion thereof is supported by rear support 28 in electric blower chamber 3. Reference numeral 29 represents a partition wall for separating electric blower chamber 3 and dust box receiving portion 5. An approximately central portion of partition wall 29 is provided with lattice-shaped communication hole 30 communicating with air suction opening 2*a* of electric blower 2. Lattice-shaped communication hole 30 is covered by third filter 31 at dust box receiving portion 5.

Figure 4:
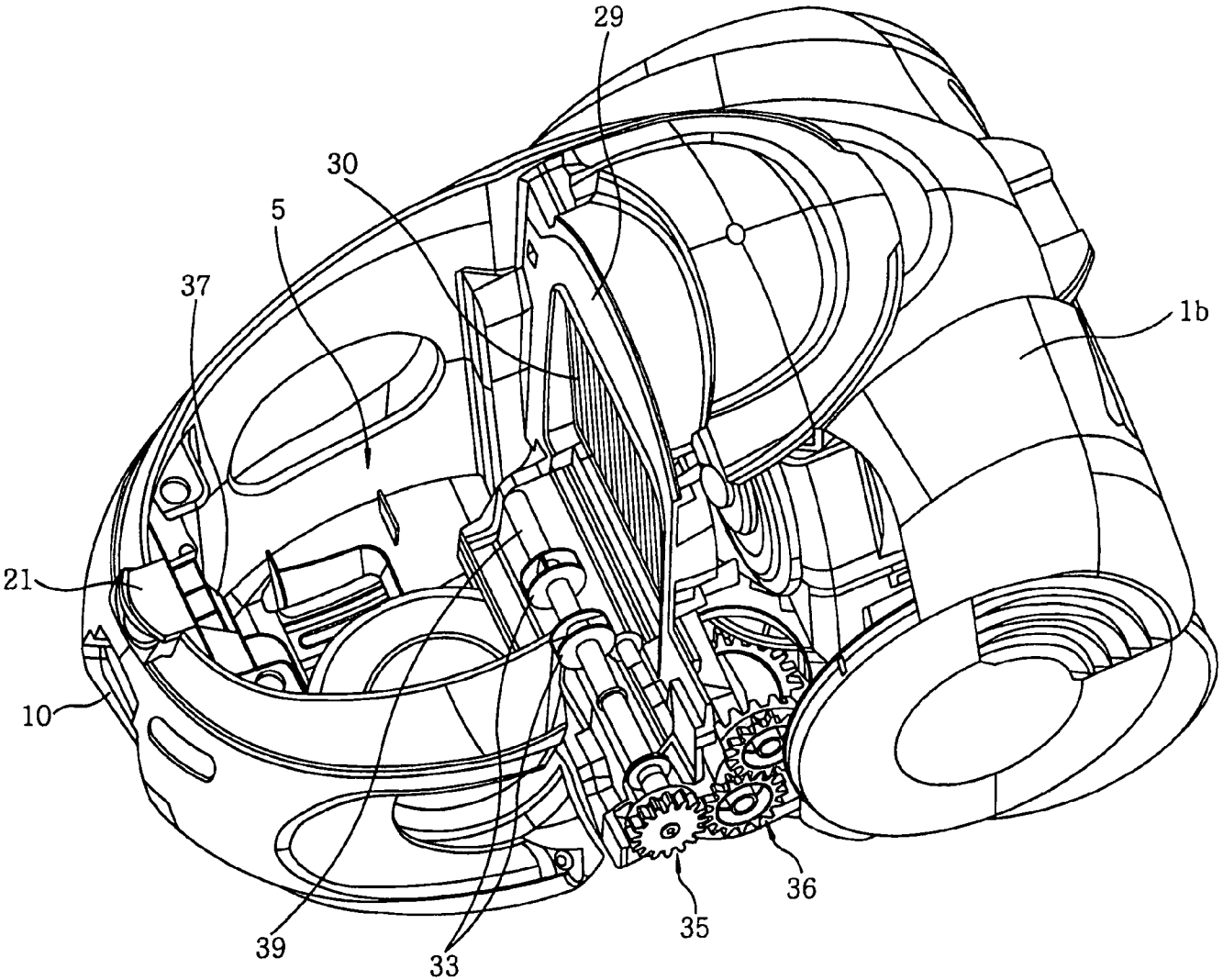
FIG. 4 depicts a perspective view of a main body of the vacuum cleaner.

FIG. 4 shows a perspective view of main body 1 after removing dust box unit 4 therefrom. Installed at a rear portion of suction air inlet 10 is packing 37 and provided at a lower rear portion of dust box receiving portion 5 are dust rollers 33 (rotating body for removing dust particles). Dust rollers 33 rotate in combination with the extraction of power cord 32 to shake dust removing plate 57 as will be described later. Reference numeral 39 represents a cover for covering dust rollers 33. If undesired matters such as hairs are attached on dust rollers 33, they can be easily removed after opening cover 39.

Figure 5:
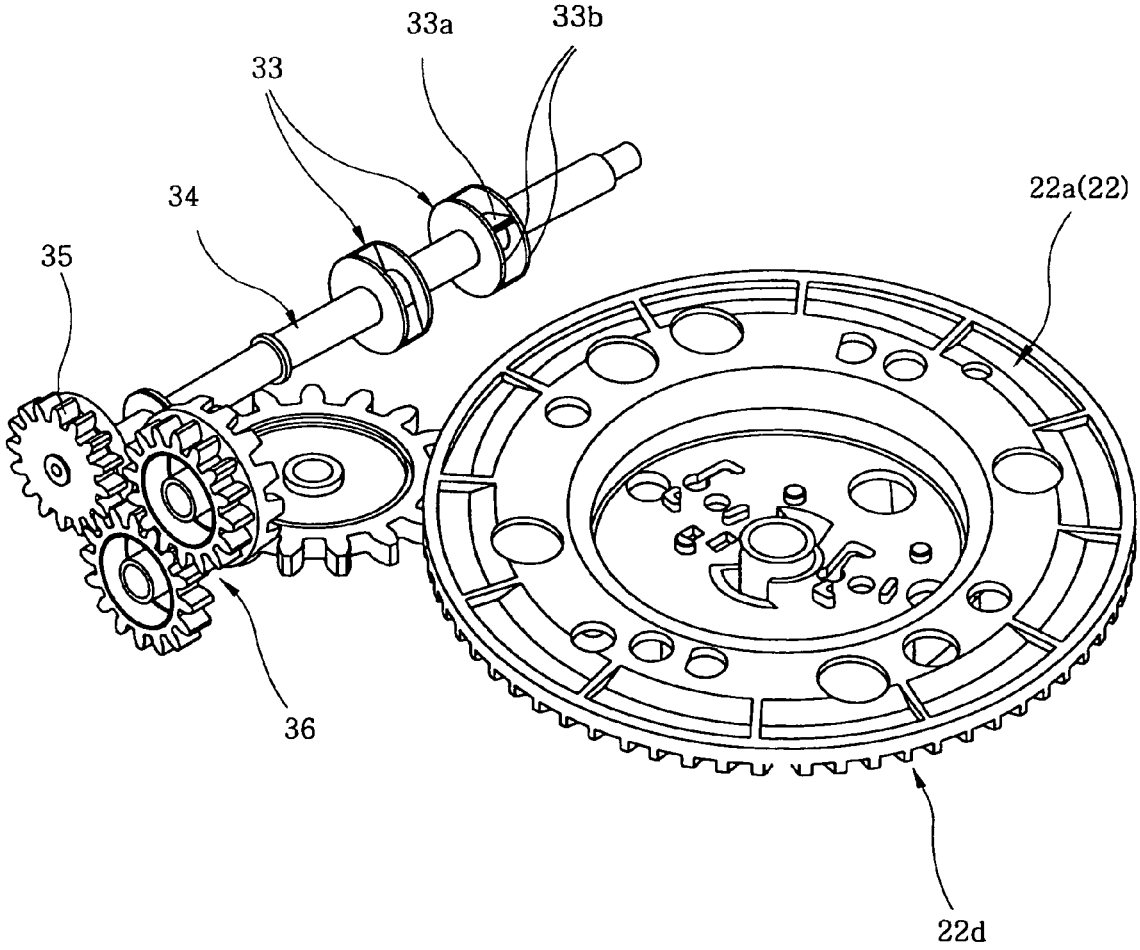
FIG. 5 provides a diagram showing a power transmission system installed inside of the vacuum cleaner.

FIG. 5 illustrates a view showing the mechanism of transmitting rotational force to dust rollers 33 when power cord 32 is extracted. One of flanges 22*a* of cord reel 22 has at its periphery gear teeth 22*d* in annular shape. Dust rollers 33 are fitted around shaft 34 having at its one end gear 35. A plurality of gear groups 36 is positioned between gear teeth 22*d* and gear 35. In the above mentioned configuration, when flanges 22*a* of cord reel 22 rotate in response to the extraction of power cord 32, the rotational force thereof is transmitted to dust rollers 33 via gear teeth 22*d*, gear groups 36, gear 35 and shaft 34 in that order, thereby rotating dust rollers 33.

Each of dust rollers 33 has flanges 33*b* interposing dust pieces 33*a* therebetween.

Hereinafter, a configuration of dust box unit 4 will be described with reference to FIGS. 6 to 12.

Dust box unit 4 includes dust box main body 40 and filter unit 41 installed at a rear opening of dust box main body 40 in such a way that it can be freely attached thereto and detached therefrom.

Above all, a mechanism for collecting dust particles sucked with air through suction head 16 will be described. When the dust box unit 4 is installed in dust box receiving portion 5 of main body 1, a front portion of dust box main body 40 is provided with suction air inlet 42 communicating with packing 37 provided at a rear portion of suction air inlet 10 of main body 1 and hook engagement 52 engaged with hook 21, wherein suction air inlet 42 is in airtightly pressurized contact with packing 37.

Dust box main body 40 includes rough dust chamber 43 directly communicating with suction air inlet 42, for storing therein rough dust particles; centrifugal separating chamber 45 communicating with rough dust chamber 43 via communicating opening 44, for centrifugally separating fine dust particles contained in a suction air flow; fine dust chamber 47 for collecting fine dust particles that have fallen down from communicating opening 46 provided at a part of a peripheral wall of centrifugal separating chamber 45; and lid 48 whose rear end portion is rotatably supported at dust box main body 40 while blocking respective openings 43*b* and 47*b* of rough dust chamber 43 and fine dust chamber 47. Lid 48 is pressurized in an opening direction thereof by coil spring 49. In general, a front portion of lid 48 is in a closed state by engagement piece 50 provided at dust box main body 40. If release button 51 provided at a front portion of box handle 20 is pressed, engagement piece 50 outwardly moves via a coupling mechanism (not illustrated) connected to release button 51. As a result, lid 48 can be opened by the pressing force of coil spring 49.

Figure 6A:
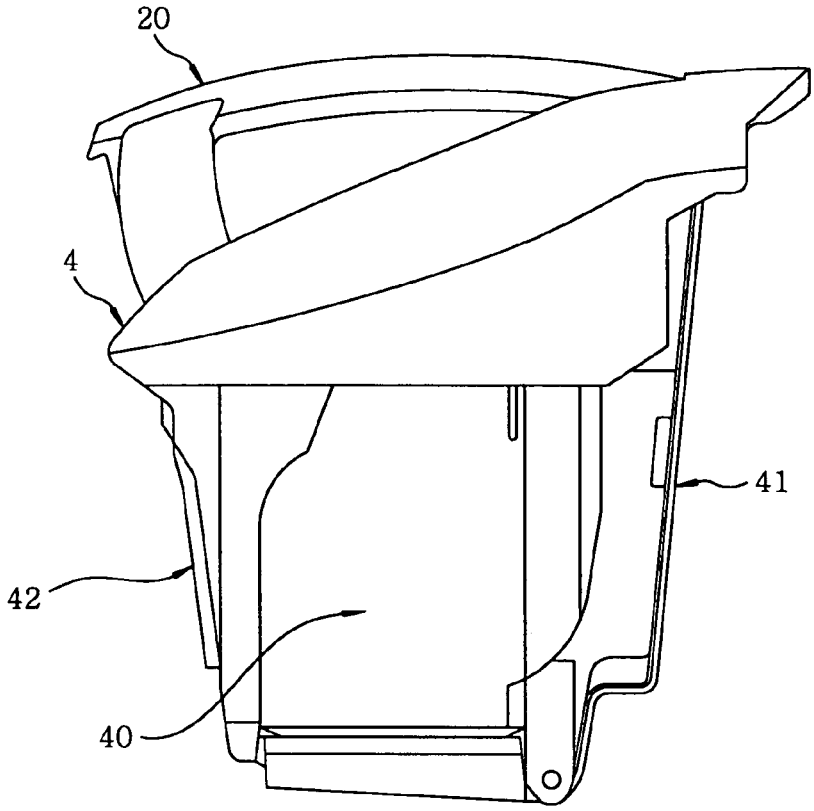
FIGS. 6A to 6D present a side view of a dust box unit of the vacuum cleaner, a top view of the dust box unit, a cross sectional view taken along line 6C-6C of FIG. 6B and a cross sectional view taken along line 6D-6D of FIG. 6B, respectively.
Figure 6B:
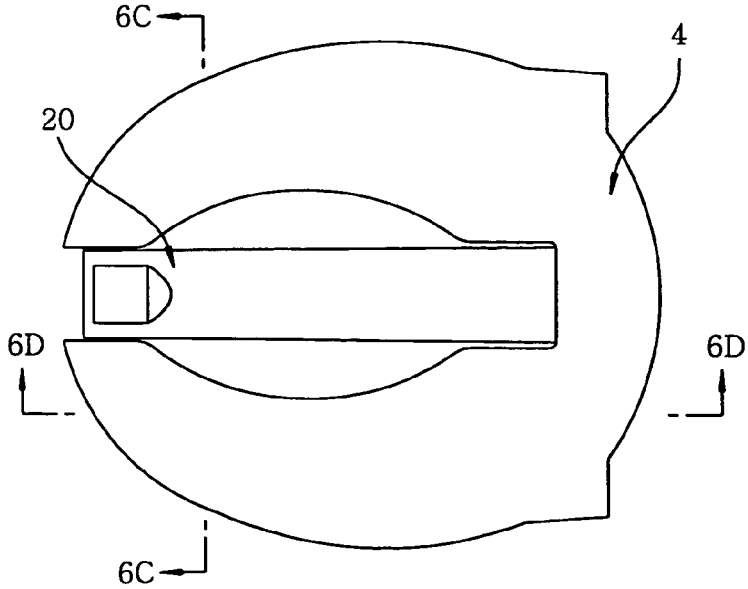
Figure 6D:
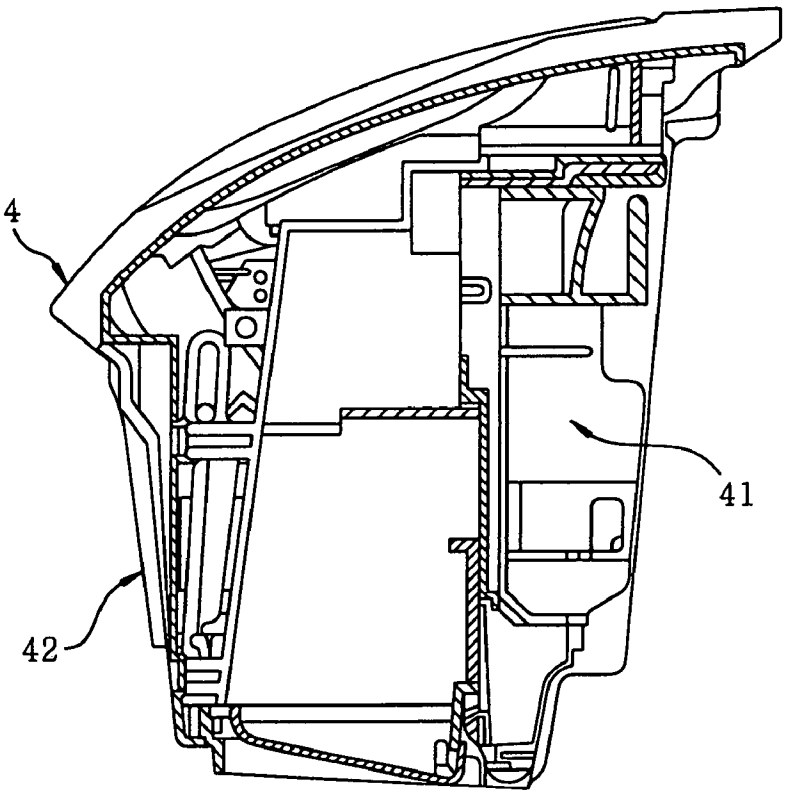
Figure 6C:
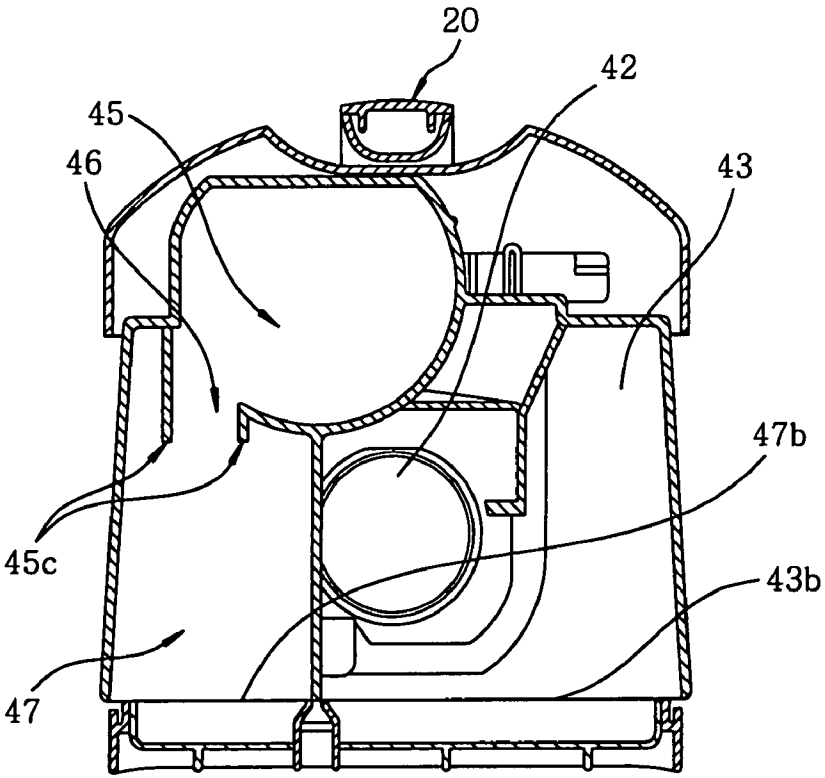
Figure 7:
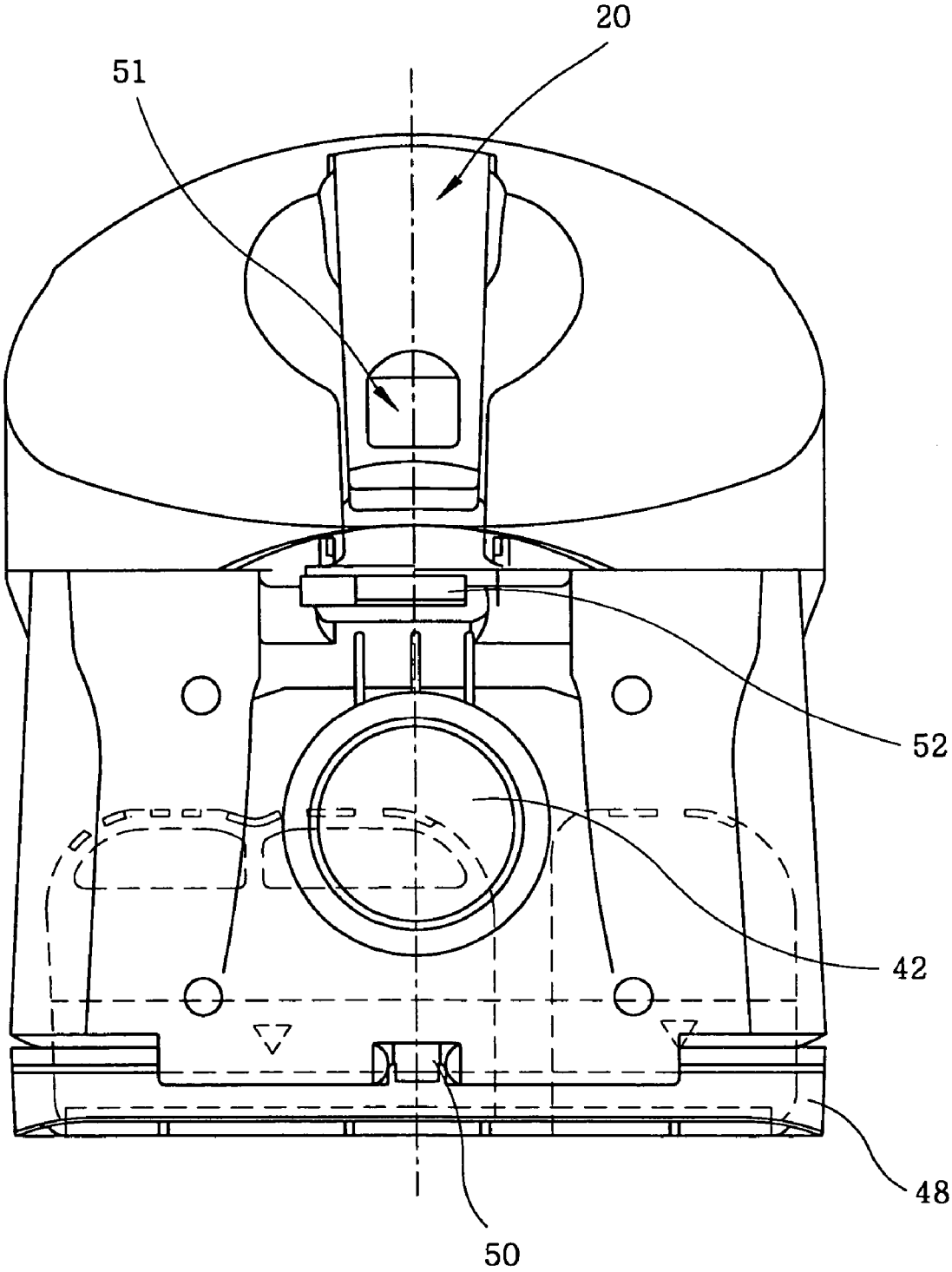
FIG. 7 represents a front view of the dust box unit.

As illustrated in FIG. 6C, a cross section of a front portion of centrifugal separating chamber 45 is formed in a D shape whose upper surface is flat. Accordingly, a surface of a front portion of dust box unit 4 forming a partial outer portion of main body 1 becomes lowered such that there will be given more freedom and flexibility in designing to have various shapes. Further, cylindrical lip 45*c* extends from communicating opening 46 toward fine dust chamber 47 to prevent fine dust particles flown into fine dust chamber 47 from flowing backwardly into centrifugal separating chamber 45.

Moreover, since outer portions respectively forming rough dust chamber 43 and fine dust chamber 47 of dust box main body 40 are made of a semitransparent material, the amount of dust particles accumulated can be seen from outside.

Installed at a rear side of dust box main body 40 is brush receiving portion 40*a* for storing therein cleaning brush 53 for cleaning dust particles attached to dust box unit 4 or components thereof.

Filter unit 41 includes frame body 54; vertically pleat-folded second filter 55 provided in frame body 54; rib bodies 56 formed inside frame body 54 in a bridge shape while maintaining second filter 55 in a direction perpendicular to the folded direction; and dust removing plate 57 whose upper portion is attached to an upper portion of frame body 54 so that a lower portion of dust removing plate 57 can be firmly pressurized against frame body 54 with the elastic force thereof, dust removing plate 57 being made of elastic metal such as a steel sheet or the like. Lip 58 is formed as a unit at an overall downstream end portion of frame body 54 of filter unit 41. When dust box unit 4 is installed inside dust box receiving portion 5, lip 58 comes to have a pressurized contact with a surface of dust box receiving portion 5 of partition wall 29 of main body 1, thereby preventing outside air from being sucked during an operation of electric blower 2.

Front surface 59 of filter unit 41 covers an upper portion of second filter 55, and further airtightly covers surroundings of respective rear openings 43*a*, 45*a* and 47*a* of rough dust chamber 43, centrifugal separating chamber 45 and fine dust chamber 47 when filter unit 41 is installed in dust box main body 40. Furthermore, openings 60, 61 and 62 are provided at positions corresponding to rear openings 43*a*, 45*a* and 47*a* provided at front surface 59 of filter unit 41, respectively. Besides, first filters 60*a*, 61*a* and 62*a* are provided at openings 60, 61 and 62, respectively, thereby preventing rough or fine dust particles from flowing into filter unit 41.

Figure 11:
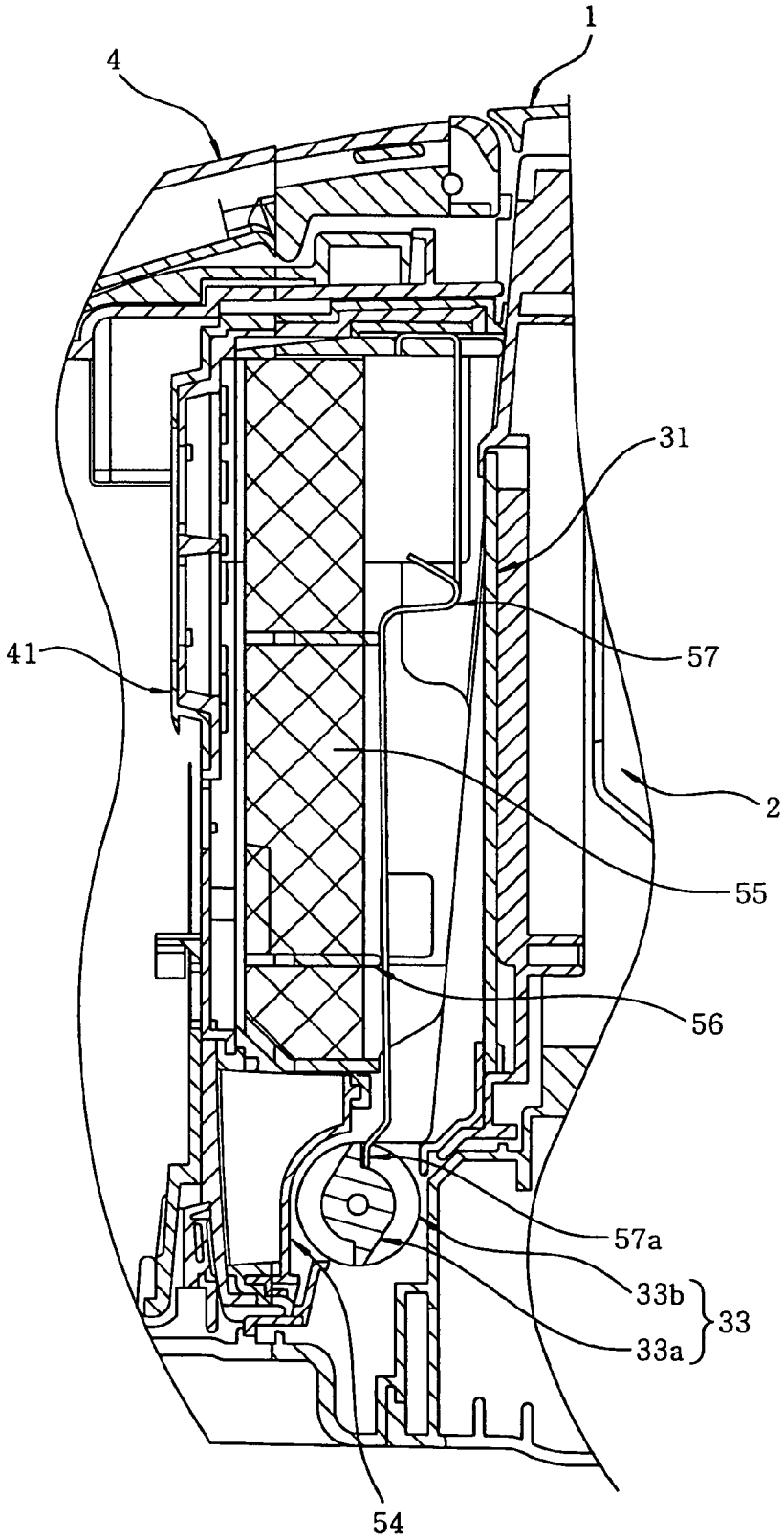
FIG. 11 shows a cross sectional view describing principal parts of the dust box unit.
Figure 12:
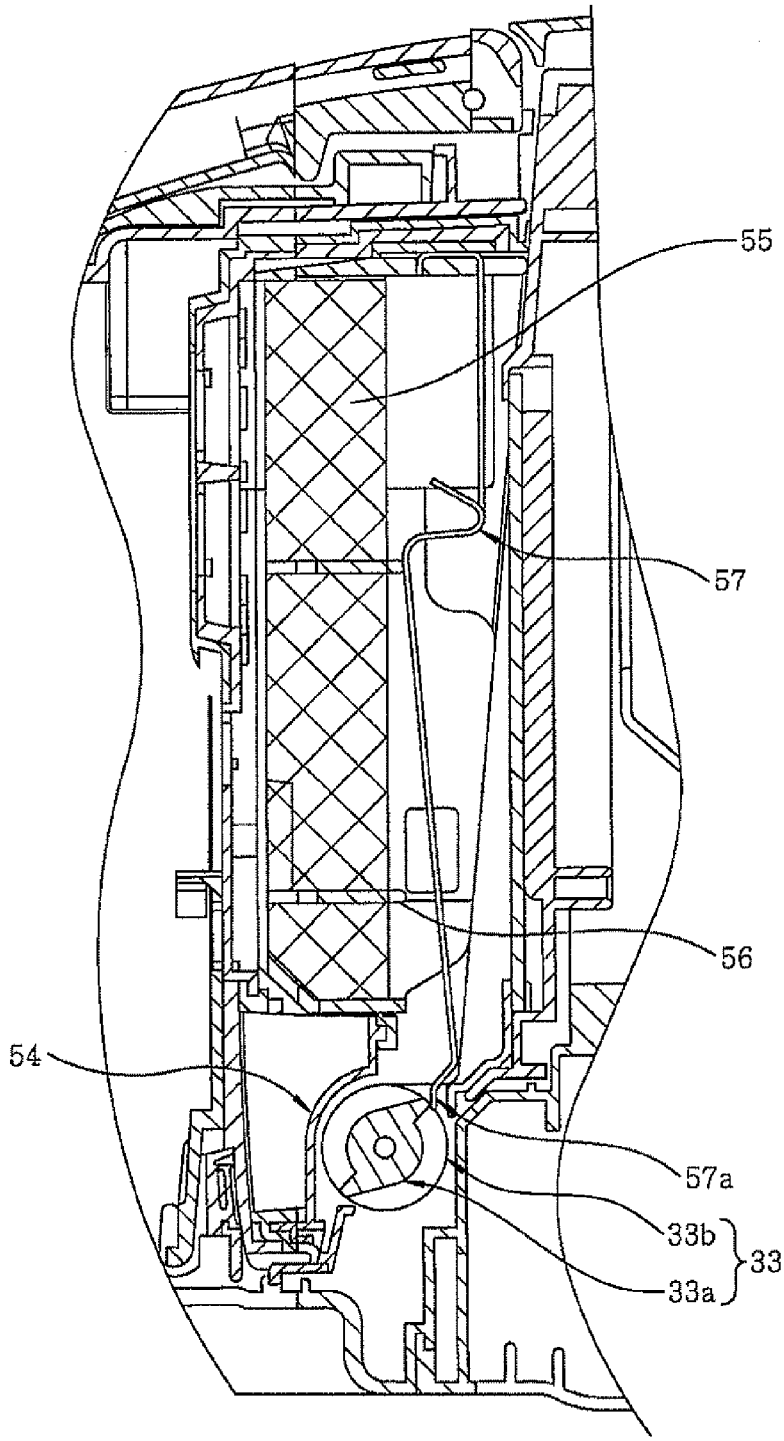
FIG. 12 provides a cross sectional view depicting principal parts of the dust box unit.

Protrusions 57*a* are extended at a lower end of dust removing plate 57. Thus, as illustrated in FIGS. 11 and 12 describing a cross sectional view of principal parts, when dust box unit 4 is accommodated in dust box receiving portion 5, protrusions 57*a* are to be closely positioned to dust rollers 33 installed in main body 1. In this state, if power cord 32 is extracted, dust rollers 33 rotate in combination with an extraction of power cord 32 and, accordingly, protruding dust pieces 33*a* move protrusion 57*a* of dust removing plate 57 along an air flow direction, i.e., toward a rear portion, against the elastic force of dust removing plate 57. If protrusions 57*a* resist dust pieces 33*a* (see FIG. 12), protrusions 57*a* tend to immediately move toward an original left direction due to the elastic force. At this time, a part of dust removing plate 57 collides with a leading end of rib body 56 and, thus, a strong impact is applied to rib body 56. Accordingly, by applying a strong impact to second filter 55, the fine dust particles attached to second filter 55 are detached, which recovers a filtering efficiency of second filter 55.

The following is an operation of the aforementioned configuration.

If power cord 32 is extracted from main body 1 to use a vacuum cleaner, flanges 22*a* of cord reel 22 rotate in combination with the extraction of power cord 32. A rotational force thereof is transmitted to gear group 36 and gear 35, thereby rotating dust rollers 33. If dust rollers 33 rotate, dust pieces 33*a* strike protrusions 57*a* installed at dust removing plate 57, thereby applying a strong impact on rib body 56 of filter unit 41. Accordingly, the fine dust particles attached to second filter 55 up to a previous cleaning are detached and, further, a filtering efficiency of second filter 55 is recovered.

Next, if a vacuum cleaner starts to be driven by plugging power cord 32 into a wall outlet (not shown), a suction force of electric blower 2 is transmitted to rough dust chamber 43, centrifugal separating chamber 45 and fine dust chamber 47 in that order via openings 60, 61 and 62 and first filters 60*a*, 61*a* and 62*a*. Then, the suction force thereof is transmitted to suction head 16 via hose 8 and extension pipe 13. Further, air containing dust particles sucked from suction head 16 directly flows from suction air inlet 42 of dust box unit main body 40 toward rough dust chamber 43 through suction air inlet 10, and then collides with first filter 60*a*. In this manner, the dust particles are collected and accumulated therein.

Since the suction force of electric blower 2 is also applied to centrifugal separating chamber 45, some of air whose rough dust particles have been removed into rough dust chamber 43 flow into centrifugal separating chamber 45 through communication opening 44 positioned at suction air inlet 42. Herein, the air flows into centrifugal separating chamber 45 along a surface of first filter 61*a* in a tangential direction thereof and, thus, a centrifugal separation of dust particles can be effectively carried out. Further, the dust particles are hardly attached to first filter 61*a* and, therefore, first filter 61*a* becomes hardly full of dust particles. As a result, it is possible to prevent a loss in air pressure from being deteriorated in first filter 61*a*.

The fine dust particles centrifugally separated to be flown into centrifugal separating chamber 45 are dusted off through communicating opening 46 installed at a part of a peripheral wall of centrifugal separating chamber 45 toward fine dust chamber 47. Meanwhile, air containing fine dust particles that has passed first filters 60*a*, 61*a* and 62*a* flows into pleat-shaped second filter 55 to be captured therein. As described above, the captured fine dust particles will be dusted off by dust removing plate 57 when power cord 32 being extracted to use the vacuum cleaner in next time.

In such configuration, since rough dust particles are collected beforehand in rough dust chamber 43, the burden of a centrifugal separation of dust particles in centrifugal separating chamber 45 can be reduced. Moreover, since fine dust particles separated therein are collected in fine dust chamber 47, the amount of fine dust particles remaining in centrifugal separating chamber 45 can be reduced. Accordingly, a high centrifugal separation efficiency can be maintained for a long time.

Besides, if it is configured such that the loss in the suction air pressure in fine dust chamber 47 is set to be higher than those in centrifugal separating chamber 45 and in rough dust chamber 43, the amount of fine dust particles remaining in centrifugal separating chamber 45 is effectively reduced, thereby making it possible to maintain a high centrifugal separation efficiency for a long time.

Furthermore, if mesh size or materials of first filters 60*a*, 61*a* and 62*a* and areas of openings 60, 61 and 62 are prepared so that the amount of suction air in centrifugal separating chamber 45 becomes greater than or equal to at least 1.3 $m^3$/min, the amount of air for cooling electric blower 2 is sufficiently secured. Accordingly, a lifetime of electric blower 2 becomes prolonged and, further, abnormal heat generation and destruction by fire of electric blower 2 can be prevented.

Figure 10:
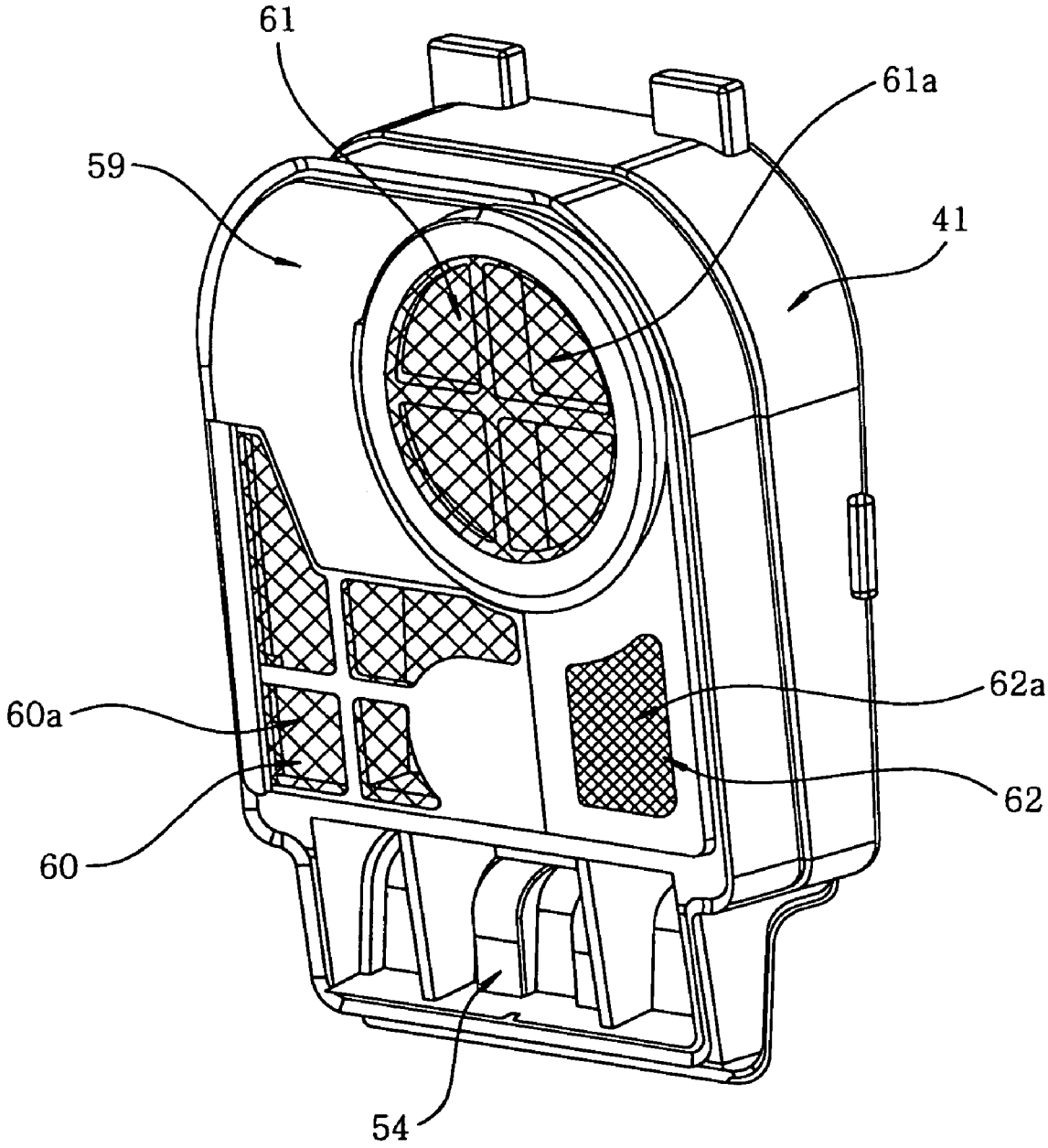
FIG. 10 is a perspective view of a filter unit of the dust box unit.

As depicted in FIG. 10, since first filters 60*a*, 61*a* and 62*a* are installed on a same surface, it is easy to clean and use them and, further, there is no leak. Though first filters 60*a*, 61*a* and 62*a* are installed on the same surface in this embodiment, a little step up to 6 mm can be permitted among first filters 60*a*, 61*a* and 62*a* or between first filters 60*a*, 61*a* and 62*a* and front surface 59 without adding any inconvenience in cleaning first filters 60*a*, 61*a* and 62*a*.

Protrusions 57*a* of dust removing plate 57 are struck by rotating dust rollers 33 and, further, such generated impact due to a reaction force thereof is transmitted to frame body 54. Therefore, dust particles attached to an upstream surface of second filter 55 are dusted off by the impact applied from dust removing plate 57 to frame body 54 in an opposite direction of an air flow, i.e., in a dust particle accumulation direction and, further, a filtering efficiency of second filter 55 is recovered. Herein, since dust removing plate 57 does not directly apply the impact on second filter 55, a lifetime of second filter 55 becomes prolonged.

Since dust rollers 33 are rotated by means related with the extraction of power cord 32, there is no need to provide an additional driving source for rotating dust rollers 33, thereby making it possible to manufacture a dust removing mechanism at a low cost. Moreover, if dust rollers 33 are made to be rotated by means related with a retracting operation of power cord 32 or both of the extracting and retracting operations of power cord 32, rotating chances of dust rollers 33 increase, thereby improving a dust removing efficiency.

Although it is not illustrated, if dust rollers 33 are rotated by an additional motor, a dust removing mechanism becomes simple and, further, a stable dust removing effect can be realized.

Since an upper portion of dust removing plate 57 is fixed on the upper portion of frame body 54, a configuration of main body 1 becomes simple, thereby realizing a stable dust removing effect.

Since vertically pleat-folded second filter 55 is provided, dust particles that have been filtered out can effectively be dusted off, and further can be prevented from being attached to second filter 55 again.

If an upstream surface of the upper portion of second filter 55 is slightly inclined downward, the dust particles that have been filtered out can be effectively dusted off downward, and further can be prevented from being attached to second filter 55 again.

Rib body 56 for connecting pleat portions of second filter 55 is provided as a unit at frame body 54 made of resin. Since rib body 56 is struck by dust removing plate 57, the impact can be transmitted to overall second filter 55 via rib body 56, thereby enhancing the dusting off efficiency of the dust particles.

Figure 8:
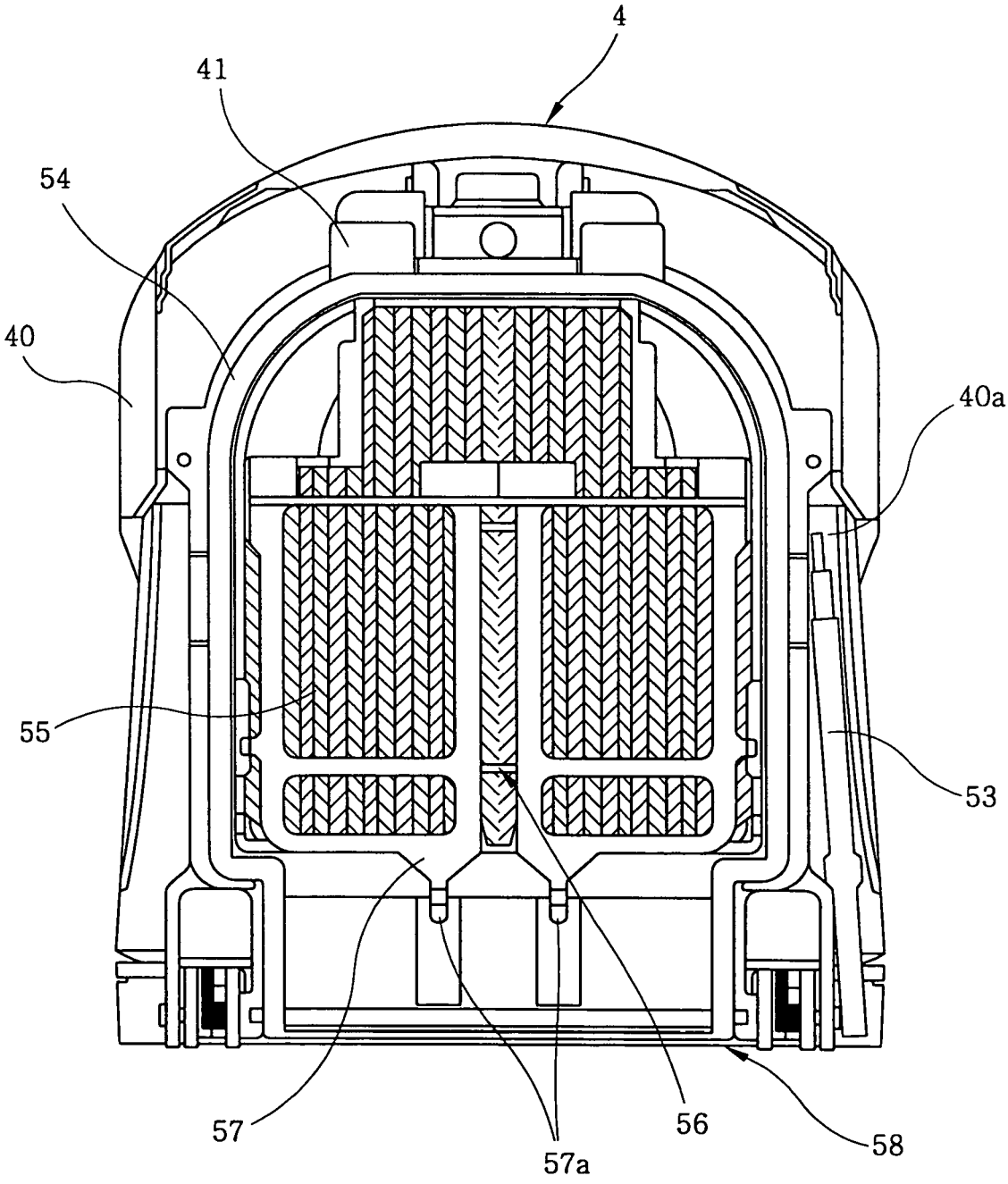
FIG. 8 offers a rear view of the dust box unit.
Figure 9:
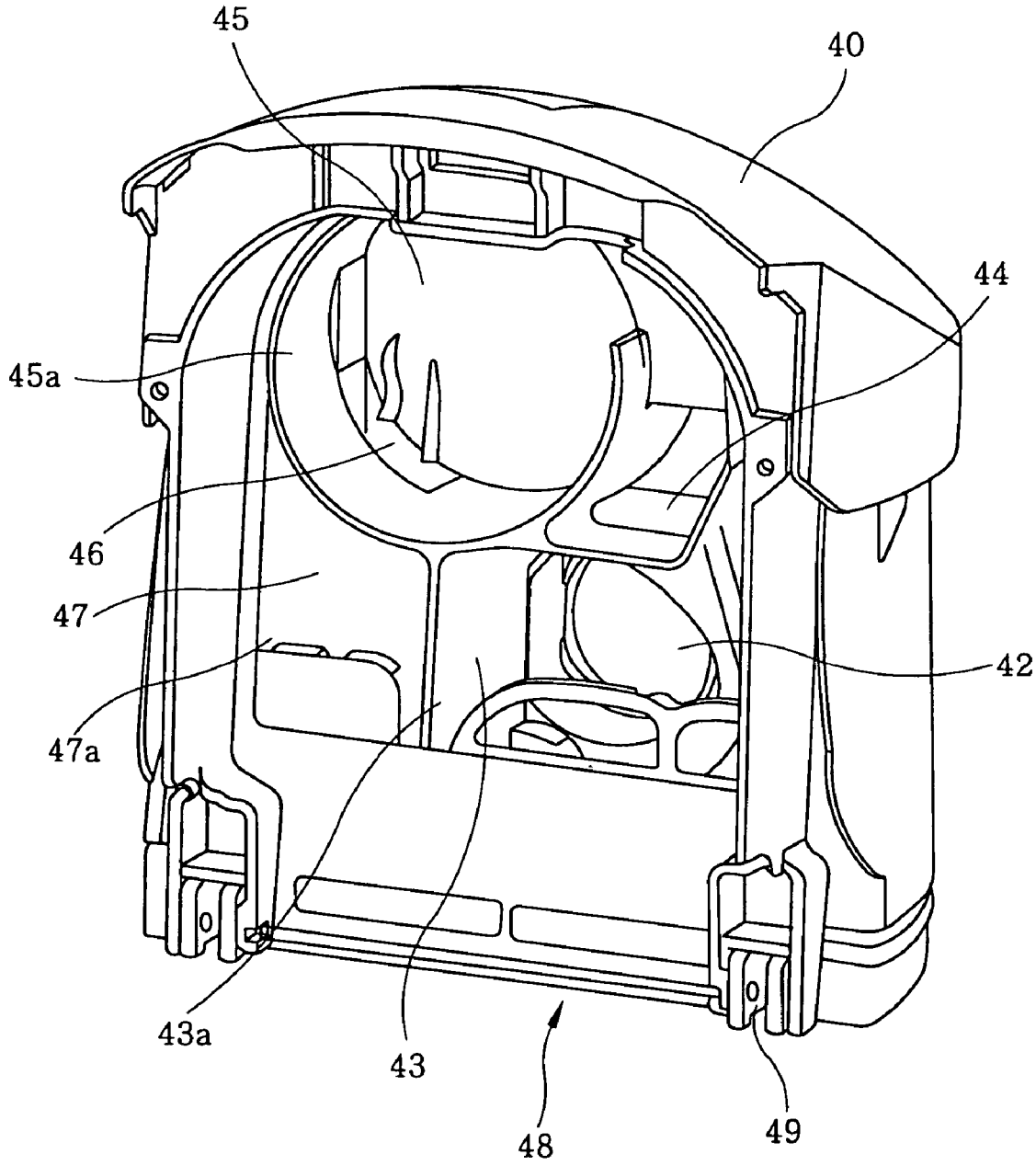
FIG. 9 illustrates a perspective view of a main body of the dust box unit.

As depicted in FIG. 8, if dust removing plate 57 is divided into two in the middle thereof and each of protrusions 57*a* is struck by dust rollers 33 at different timings, it is possible to reduce by half an extraction force needed in extracting power cord 32 or a torque of a motor needed for rotating dust rollers 33.

Further, dust removing plate 57 may be divided into three or four instead of two.

Moreover, if an impact force applied from dust removing plate 57 to second filter 55 via frame body 54 is set to be greater than or equal to 150 G (acceleration of gravity), 80% of the amount of an initial air flow can be recovered.

Besides, since each of dust rollers 33 includes dust piece 33*a* for striking protrusion 57*a* of dust removing plate 57 and flanges 33*b* provided at both sides of dust piece 33*a* such that protrusion 57*a* can be inserted between flanges 33*b*, it is possible to prevent dust pieces 33*a* from missing hitting protrusions 57*a* during the dust removing process, and further to prevent dust particles or the like from being caught in dust rollers 33.

Second Preferred Embodiment

Figure 13A:
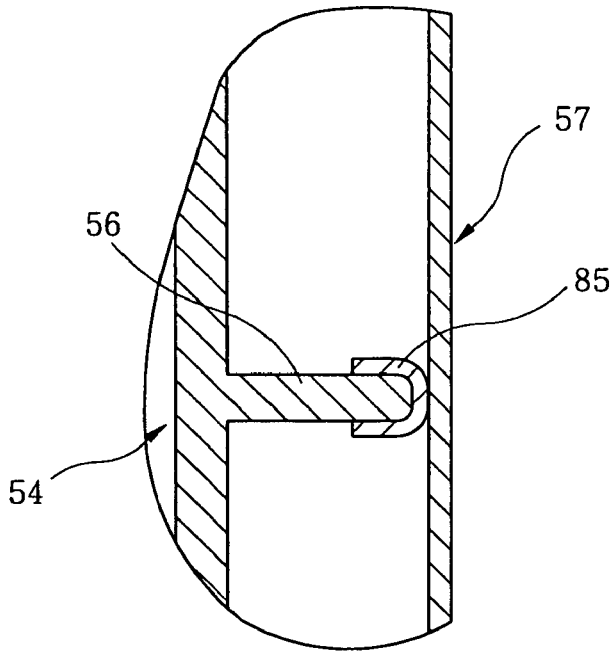
FIGS. 13A and 13B present cross sectional views illustrating principal parts of a vacuum cleaner in accordance with a second preferred embodiment of the present invention and those of another exemplary vacuum cleaner, respectively.

FIG. 13A shows a cross sectional view of principal parts of a vacuum cleaner in accordance with a second preferred embodiment of the present invention.

Figure 13B:
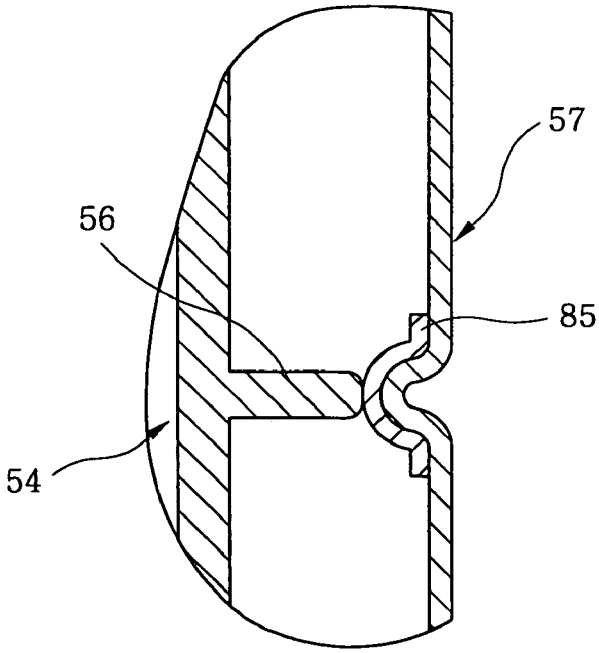

In the second preferred embodiment, noise absorber 85 is provided at an end portion of rib body 56 to be in contact with dust removing plate 57 and, accordingly, noise can be reduced during the dust removing process. Further, the same effects can be obtained when noise absorber 85 is provided at dust removing plate 57, instead of at rib body 56, as illustrated in FIG. 13B or at both of dust removing plate 57 and rib body 56 although it is not shown.

Third Preferred Embodiment

Figure 14A:
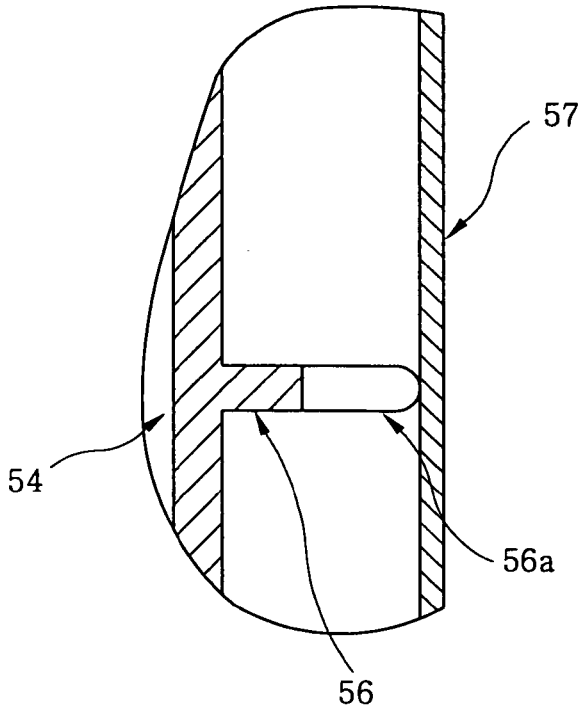
FIGS. 14A and 14B represent cross sectional views illustrating principal parts of a vacuum cleaner in accordance with a third preferred embodiment of the present invention and those of another exemplary vacuum cleaner, respectively.

FIG. 14A provides a cross sectional view of principal parts of a vacuum cleaner in accordance with a third preferred embodiment of the present invention. In the third preferred embodiment, irregularity 56*a* is provided at an end portion of rib body 56 so that dust removing plate 57 can make a partial contact therewith. Therefore, an impact applied to a filter can be distributed and sound quality can be changed or reduced during the dust removing process.

Figure 14B:
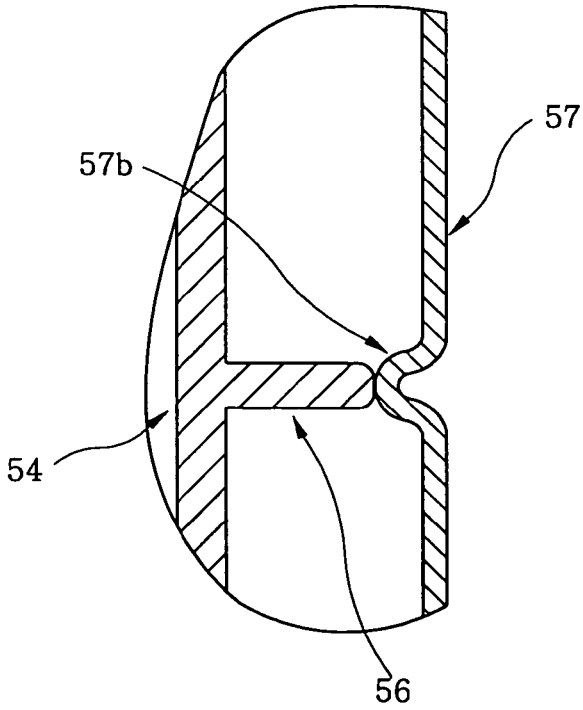

Moreover, by providing irregularity 56*a* (contact portion) in rib body 56 at a portion where a large amount of dust particles are attached to second filter 55, a strong impact can be applied to such portion, thereby effectively removing dust particles. Further, as described in FIG. 14B, the same effects can be obtained by providing irregularity 57*b* at dust removing plate 57, instead of providing irregularity 56*a* at an end portion of rib body 56. Also, irregularities 57*b* and 56*a* can be provided at dust removing plate 57 and the end portion of rib body 56, respectively, although it is not shown.

Fourth Preferred Embodiment

Figure 15:
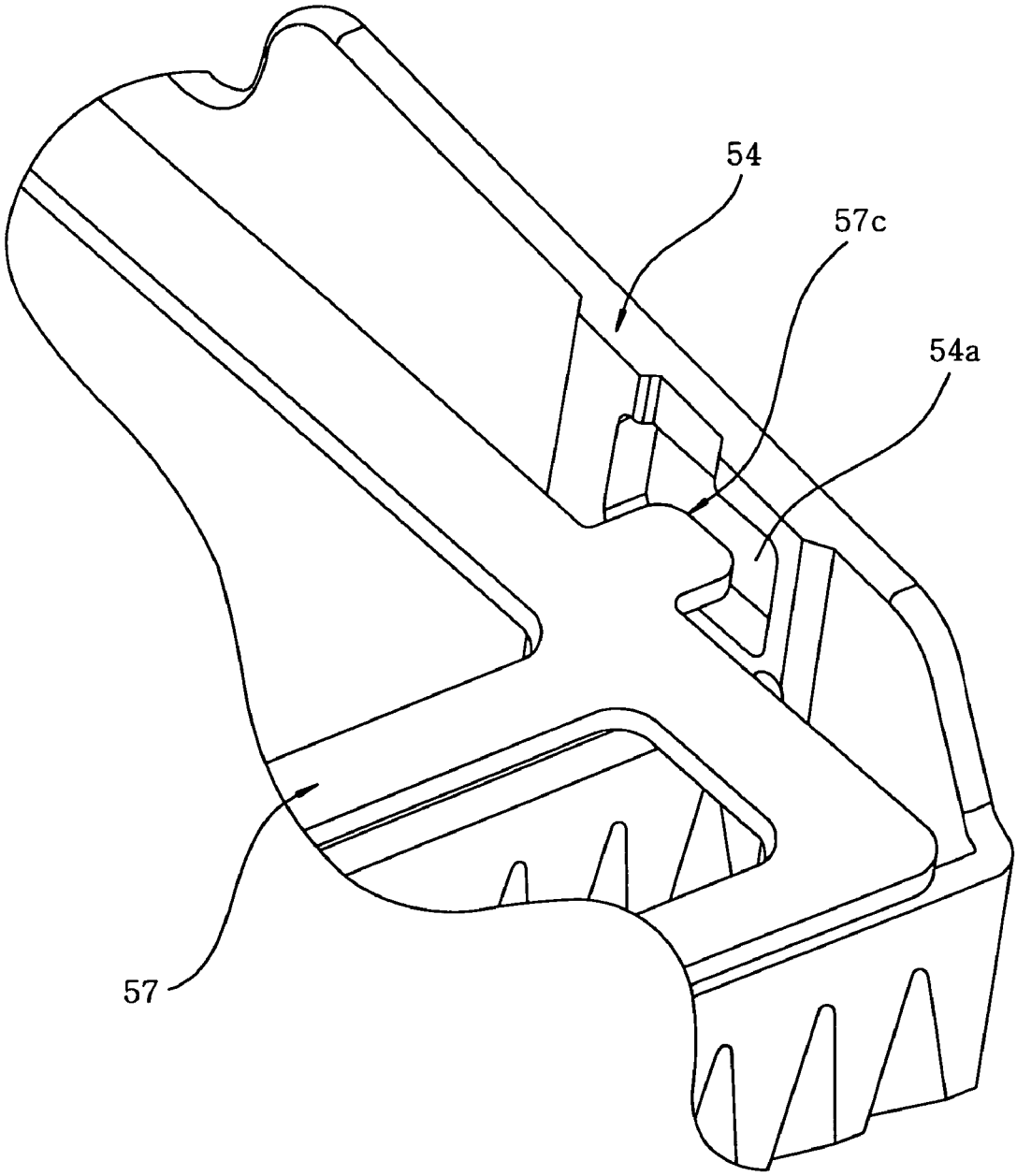
FIG. 15 offers a perspective view showing principal parts of a vacuum cleaner in accordance with a fourth preferred embodiment of the present invention.

FIG. 15 offers a perspective view of principal parts in accordance with a fourth preferred embodiment of the present invention.

In the fourth preferred embodiment, stopper portions 57*c* are provided at both sides of dust removing plate 57, and recess portions 54*a* facing stopper portions 57*c* are provided at an inner wall of frame body 54. Accordingly, dust removing plate 57 need not be bent unnecessarily, thereby making it possible to prevent dust removing plate 57 from being transformed by a collision with something else.

In the vacuum cleaner of the present invention, dust particles attached to the filter effectively are dusted off due to an instant impact applied by the dust removing plate in an opposite direction of an air flow, i.e., in a dust particle accumulation direction and, thus, a filtering capability of the filter is recovered. Further, since the dust removing plate does not directly apply an impact to the filter, the filter is free from damage.

While the invention has been shown and described with respect to the preferred embodiments, it will be understood by those skilled in the art that various changes and modification may be made without departing from the spirit and scope of the invention as defined in the following claims.

What is claimed is:

1. A vacuum cleaner comprising:

a main body accommodating therein an electric blower and a dust-removal driving body; and a filter unit including a frame body where a filter for collecting dust particles is installed, a rib body formed inside the frame body, and a dust removing plate provided at a downstream side of the filter, one end of the dust removing plate being fixed at the frame body, wherein the opposite end of the dust removing plate is struck in an air flow direction by means related with driving the dust-removal driving body, so that the dust removing plate collides with the rib body with a reaction force thereof to thereby transmit an impact on the frame body through the rib body, the impact transmitted from the frame body being applied to the filter; and wherein the filter is vertically pleat-folded, and the rib body is formed to penetrate a planar surface of the vertical pleat-folded filter and to thereby divide the vertically pleat-folded filter into an upper portion and a lower portion; and wherein the rib body is projected at a downstream side of the planar surface.

2. The vacuum cleaner of claim 1, further comprising a cord reel with a power cord wound therearound, for driving the dust-removal driving body by means related with an extracting and/or retracting operation of the power cord.

3. The vacuum cleaner of claim 1, further comprising a motor for rotating the dust-removal driving body.

4. The vacuum cleaner of claim 1, wherein an upper portion of the dust removing plate is fixed on that of the frame body.

5. The vacuum cleaner of claim 1, wherein an upstream surface of an upper portion of the filter is slightly inclined downward.

6. The vacuum cleaner of claim 1, wherein a noise absorber is provided at either one or both of the rib body and the dust removing plate, and a portion where the noise absorber is provided is configured to be struck.

7. The vacuum cleaner of claim 1, wherein an irregularity is provided at either one side or both sides of contact portions between the rib body and the dust removing plate, which allows the rib body and the dust removing plate to be point-contacted.

8. The vacuum cleaner of claim 7, wherein the contact portion between the rib body and the dust removing plate is provided at a portion where a large amount of dust particles are attached to the filter.

9. The vacuum cleaner of claim 1, wherein stopper portions for restricting a bending degree of the dust removing plate are provided at both sides of the dust removing plate.

10. The vacuum cleaner of claim 1, wherein the dust removing plate is divided into at least two in the middle thereof, and each end portion thereof is struck by the dust-removal driving body.

11. The vacuum cleaner of claim 1, wherein an impact force applied from the dust removing plate to the filter via the frame body is set to be greater than or equal to 150 G.

12. The vacuum cleaner of claim 1, wherein the dust-removal driving body includes a dust piece for striking an end portion of the dust removing plate and flanges provided at both sides of the dust piece so that the end portion of the dust removing plate is inserted between the two flanges.

13. The vacuum cleaner of claim 1, further comprising a detachable cover for covering a periphery of the dust-removal driving body.

14. The vacuum cleaner of claim 1, wherein a leading end of the rib body is protruded toward the dust removing plate from the frame body.

15. The vacuum cleaner of claim 1, wherein a leading end of the rib body is positioned between the filter and the removing plate.

16. A vacuum cleaner comprising:

a main body accommodating therein an electric blower and a dust-removal driving body; and a filter unit including a frame body where a filter for collecting dust particles is installed, a rib body formed inside the frame body, and a dust removing plate provided at a downstream side of the filter, one end of the dust removing plate being fixed at the frame body, wherein the opposite end of the dust removing plate is struck in an air flow direction by means related with driving the dust-removal driving body, so that the dust removing plate collides with the rib body with a reaction force thereof to thereby transmit an impact on the frame body through the rib body, the impact transmitted from the frame body being applied to the filter; and wherein the filter is vertically pleat-folded, and the rib body is formed to penetrate a planar surface of, and extend through, the vertical pleat-folded filter and to thereby divide the vertically pleat-folded filter into an upper portion and a lower portion.

* * * * *